United States Patent [19]

Ohno et al.

[11] Patent Number: 4,605,611

[45] Date of Patent: Aug. 12, 1986

[54] METHOD FOR PROCESSING SILVER HALIDE COLOR PHOTOGRAPHIC MATERIAL

[75] Inventors: Shigeru Ohno; Shinzo Kishimoto, both of Kanagawa, Japan

[73] Assignee: Fuji Photo Film Co., Ltd., Kanagawa, Japan

[21] Appl. No.: 767,536

[22] Filed: Aug. 20, 1985

[30] Foreign Application Priority Data

Aug. 20, 1984 [JP] Japan ..... 59-172957

[51] Int. Cl.[4] ..... G03C 7/40; G03C 7/42

[52] U.S. Cl. ..... 430/393; 430/430; 430/460; 430/461; 430/398; 430/400; 430/428

[58] Field of Search ..... 430/393, 428, 430, 460, 430/461

[56] References Cited

PUBLICATIONS

Research Disclosure Aug. 1981, #20821, pp. 311–314.

*Primary Examiner*—Mary F. Downey

*Attorney, Agent, or Firm*—Sughrue, Mion, Zinn, Macpeak & Seas

[57] ABSTRACT

A method for processing a silver halide color photographic material by subjecting a light-exposed silver halide color photographic material to a color development and then subjecting it to bleach processing and fix processing or to blix processing, which comprises performing said bleach processing or blix processing using a bleach bath or a blix bath containing a ferric ion complex salt as a bleaching agent, said bleach bath or blix bath, or a prebath for said bath containing at least one of compounds represented by the following general formula (I) or (II);

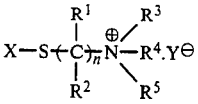

(I)

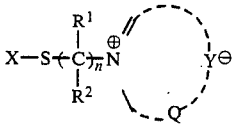

(II)

wherein, X represents a hydrogen atom,

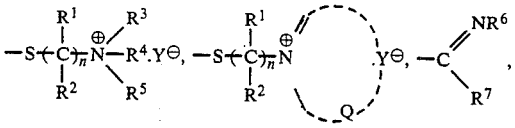

$-CR^8$, or $-CNHR^8$;

$Y^{\ominus}$ represents an anion; Q represents an atomic group necessary for forming a quaternary nitrogen-containing unsaturated heterocyclic ring; n represents an integer of 1 to 5; $R^1$, $R^2$, $R^6$ and $R^8$, which may be the same or different, each represents a hydrogen atom or a lower alkyl group; $R^3$, $R^4$ and $R^5$, which may be the same or different, each represents a substituted or unsubstituted alkyl group or a substituted or unsubstituted aryl group; any two of said $R^3$, $R^4$ and $R^5$ may combine with each other to form a ring; said $R^3$, $R^4$ or $R^5$ and said $R^1$ or $R^2$ may combine with each other to form a ring; and $R^7$ represents $-NR^9R^{10}$, $-OR^{11}$, or $-SR^{11}$ (wherein, $R^9$ and $R^{10}$, which may be the same or different, each represents a hydrogen atom or a lower alkyl group; $R^{11}$ represents an atomic group necessary for forming a ring by combining with $R^6$; and said $R^9$ or $R^{10}$ and said $R^6$ may combine with each other to form a ring).

The method of the present invention does not produce poisonous materials which are harmful to the environment and provides an excellent high speed bleaching process without harming other photographic properties.

18 Claims, No Drawings

METHOD FOR PROCESSING SILVER HALIDE COLOR PHOTOGRAPHIC MATERIAL

FIELD OF THE INVENTION

The present invention relates to a method for processing an exposed silver halide color photographic material (hereinafter referred to as a color photosensitive material) which comprises developing, bleaching, and fixing (hereinafter referred to as a color photographic processing method), and, more particularly, to an improved bleaching process which accelerates the bleaching function, thus shortening the processing time while providing sufficient bleaching, thus providing a color photographic image of good image quality.

BACKGROUND OF THE INVENTION

The fundamental steps of processing color photosensitive materials generally include a color developing step and a desilvering step. Thus, an exposed color photosensitive material is introduced into a color developing step, where silver halide is reduced with a color developing agent to produce silver and the oxidation product of color developing agent in turn reacts with coupler to yield a dye image. Subsequently, the color photosensitive material is introduced into a desilvering step, where silver produced in the preceding step is oxidized with an oxidizing agent (usually called a bleaching agent), and dissolved away by the action of a silver ion complexing agent usually called a fixing agent. Therefore, only a dye image is formed in the thus processed color photosensitive material. In addition to the above described two fundamental steps of color development and desilveration, actual development processing involves auxiliary steps for maintaining the photographic and physical quality of the resulting image or for improving the preservability of the image. For example, there are illustrated a hardening bath for preventing a light-sensitive layer from being excessively softened during color photographic processing, a stopping bath for effectively stopping the developing reaction, an image stabilizing bath for stabilizing the image, and a layer removing bath for removing the backing layer on the support.

The above described desilvering step may be conducted in two ways: one way used two steps employing a bleaching bath and a fixing bath; and the other way is more simple and is conducted in one step employing a bleach-fixing bath containing both a bleaching agent and a fixing agent for the purpose of accelerating the processing and labor elimination.

Ferricyanide and ferric chloride, heretofore used as bleaching agents, are good bleaching agents due to their high oxidizing power. However, a bleaching solution or bleach-fixing solution containing ferricyanide as a bleaching agent can release poisonous cyanide by photolysis causing environmental pollution. Accordingly, waste processing solutions thereof must be rendered harmless in view of environmental pollution. A bleaching solution containing ferric chloride as a bleaching agent is not desirable because materials of vessels in which the solution is retained are liable to be corroded due to the extremely low pH and high oxidizing power of the solution. In addition, iron hydroxide is precipitated in an emulsion layer during a water-washing step after a bleaching step using ferric chloride, resulting in staining.

On the other hand, potassium dichromate, quinones, copper salts, etc., which have been used as bleaching agents have weak oxidizing power and are difficult to handle.

In recent years, bleach processing using a ferric ion complex salt (e.g., aminopolycarboxylic acid-ferric ion complex salt, particularly iron (III) ethylenediaminetetraacetate complex salt) as a major bleaching bath component has mainly been employed in processing color photosensitive materials in view of the acceleration and simplification of the bleaching provided and the need to prevent environmental pollution.

However, ferric ion complex salts have a comparatively low oxidizing power and, therefore, have insufficient bleaching power. A bleaching or bleach-fixing solution containing such a complex salt as a bleaching agent can attain some desirable objects when bleaching or bleach-fixing a low speed color photosensitive material containing, for example, a silver chlorobromide emulsion as a major component. However, such a solution fails to fully desilver due to insufficient bleaching power or requires a long time to bleach when processing a high speed, spectrally sensitized color photosensitive material containing a silver chlorobromoiodide emulsion or a silver iodobromide emulsion as a major component, particularly color reversal photosensitive materials for photographing or color negative photosensitive materials for photographing comprising an emulsion containing a larger amount of silver.

Other known bleaching agents than ferric ion complex salts include persulfates. Persulfates are usually used in a bleaching solution together with a chloride. However, this persulfate-containing bleaching solution has less bleaching ability than ferric ion complex salts, thus requiring a substantially long period of time for bleaching.

As described above, bleaching agents which do not cause environmental pollution or corrode vessels and apparatus have only a weak bleaching ability. Hence, it is requested to enhance the bleaching ability of a bleaching solution or a bleach-fixing solution containing a weak bleaching agent, particularly a ferric ion complex salt.

In order to raise the bleaching ability of a bleaching solution or a bleach-fixing solution containing a ferric ion complex salt such as iron (III) ethylenediaminetetraacetate as a bleaching agent, it has been proposed to add various bleach accelerating agents to the processing bath.

Examples of such bleach accelerating agents include 5-membered heterocyclic mercapto compounds as described in British Pat. No. 1,138,842, thiadiazole derivatives as described in Swiss Pat. No. 336,257, thiourea derivatives, and thiazole derivatives, etc. However, these compounds do not necessarily have sufficient bleach accelerating effects when they are added to a bleaching solution or a prebath thereof. Also, only insufficient bleach accelerating effects are obtained when they are added to a bleach-fixing solution or a prebath thereof. Further, in the latter case they react with silver ions present in the bleach-fixing solution to form precipitate which creates many troubles. For example, the precipitate chokes up filters of a circulation system in an automatic processing machine and it adheres on color photosensitive materials, resulting in stain formation.

A processing method is also known wherein a 5-membered heterocyclic compound containing two or three nitrogen atoms as ring constituting members and having at least one mercapto group is added to a bath just before a bath of the bleaching processing as described in Japanese Patnet Application (OPI) No. 52534/79. However, when these compounds are directly added to a bleaching solution or a bleach-fixing solution, sufficient bleach accelerating effects cannot be obtained. In addition, they lack stability in the processing solution and cannot endure use for a long period of time.

Furthermore, heterocyclic alkylmercaptan derivatives as described in Japanese Patent Application (OPI) No. 32736/78, disulfide compounds as described in Japanese Patent Application (OPI) No. 95630/78, isothiourea derivatives as described in *Research Disclosure,* No. 15704 (May 1977), and aminoalkylmercaptan derivatives as described in U.S. Pat. No. 3,893,858 are known as bleach accelerating agents. Some of these bleach accelerating agents show a substantially satisfactory bleach accelerating effect. However, when the color photosensitive material is continuously processed with a bleaching solution containing these bleach accelerating agents, they form precipitate in the bleaching solution to create many troubles. For example, the precipitate chokes up filters of a circulation system in an automatic processing machine and it adheres on color photosensitive materials, resulting in stain formation.

A processing method is known wherein mercaptalkyl quaternary ammonium salt derivatives of the present invention are added to a bath just before a bath of the bleaching processing containing persulfates as a bleaching agent as described in *Research Disclosure,* No. 20821 (August 1981), but a processing method is not known wherein the mercaptoalkyl quaternary ammonium salt derivatives of the present invention are added to a bath of the bleaching processing containing a ferric ion complex salts as a bleaching agent or a prebath thereof.

SUMMARY OF THE INVENTION

An object of the present invention is to provide a method for processing a color photosensitive material, which does not release extremely poisonous materials, which meets the requirements of preventing environmental pollution and which has excellent bleaching speed.

Another object of the present invention is to provide a method involving a bleaching or bleach-fixing step in which enhanced bleaching ability is attained without deteriorating other photographic properties using a bleaching agent having a weak bleaching ability, in particular a ferric ion complex salt.

A further object of the present invention is to provide a bleaching process which uses a bleaching or bleach-fixing solution showing increased bleaching speed and having such good stability that precipitate is not formed in the solution even in case of a continuous treatment of color photosensitive materials.

A still further object of the present invention is to provide a method which can rapidly bleach or bleach-fix a color photosensitive material having a photographing speed.

Other objects of the present invention will become apparent from the following description and examples.

These objects of the present invention are obtained by a method for processing a silver halide color photographic material by subjecting a light-exposed silver halide color photographic material to a color development and then subjecting it to bleach processing and fix processing or to blix processing, which comprises performing said bleach processing or blix processing using a bleach bath or a blix bath containing a ferric ion complex salt as a bleaching agent, said bleach bath or blix bath, or a prebath for said bath containing at least one of compounds represented by the following general formula (I) or (II);

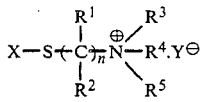

(I)

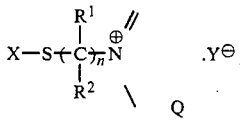

(II)

wherein, X represents a hydrogen atom,

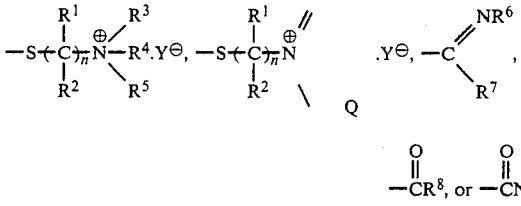

Y⊖ represents an anion; Q represents an atomic group necessary for forming a quaternary nitrogen-containing unsaturated heterocyclic ring; n represents an integer of 1 to 5; $R^1$, $R^2$, $R^6$ and $R^8$, which may be the same or different, each represents a hydrogen atom or a lower alkyl group; $R^3$, $R^4$ and $R^5$, which may be the same or different, each represents a substituted or unsubstituted alkyl group or a substituted or unsubstituted aryl group; any two of said $R^3$, $R^4$ and $R^5$ may combine with each other to form a ring; said $R^3$, $R^4$ or $R^5$ and said $R^1$ or $R^2$ may combine with each other to form a ring; and $R^7$ represents $-NR^9R^{10}$, $-OR^{11}$, or $-SR^{11}$ (wherein, $R^9$ and $R^{10}$, which may be the same or different, each represents a hydrogen atom or a lower alkyl group; $R^{11}$ represents an atomic group necessary for forming a ring by combining with $R^6$; and said $R^9$ or $R^{10}$ and said $R^6$ may combine with each other to form a ring).

In this case, when n is an integer of 2 or more, $R^1$ and $R^2$ may be the same or different. Also, each of $R^1$ to $R^5$ of

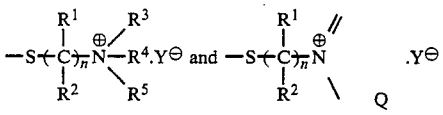

shown by X may be same as or different from each of $R^1$ to $R^5$ of the general formula (I) or (II).

In each of the general formulae (I) and (II), the alkyl group shown by $R^1$ to $R^6$ and $R^8$ to $R^{10}$ is preferably an alkyl group having 1 to 5 carbon atoms (e.g., a methyl group, an ethyl group, etc.,) and the substituent of the alkyl group and aryl group shown by $R^3$ to $R^5$ includes a hydroxy group, a carboxy group, a sulfo group, an ammonium group (e.g., a trimethylammonio group, a triethylammonio group, etc.), an alkoxy group (e.g., a methoxy group, an ethoxy group, etc.), a sulfonyl group (e.g., a methanesulfonyl group, etc.), a carbamoyl group (e.g., an unsubstituted carbamoyl group, a methylcarbamoyl group, etc.), a sulfamoyl group (e.g., an unsubstituted sulfamoyl group, a methylsulfamoyl group, etc.), an amido group (e.g., an acetylamino group, etc.), a sulfonamido group (e.g., a methanesulfonamido group, etc.), an alkoxycarbonyl group (e.g., a methoxycarbonyl group, an ethoxycarbonyl group, etc.), a carbonyloxy group (e.g., an acetoxy group, etc.), a cyano group, and a halogen atom (e.g., a chlorine atom, a bromine atom, etc.).

The ring formed by the combination of any two of $R^3$, $R^4$, and $R^5$ includes a morpholine ring, a piperidine ring, an imidazole ring, a pyrrolidine ring, etc., and also the ring formed by the combination of $R^3$, $R^4$ or $R^5$ and $R^1$ or $R^2$ includes an oxazolidine ring. The ring formed by the combination of $R^9$ or $R^{10}$ and $R^6$ or the ring formed by the combination of $R^{11}$ and $R^6$ may have a substituent such as an imidazoline ring, a benzimidazole ring, a benzothiazole ring, a benzoxazole ring, a pyrimidine ring, a 5-methoxybenzimidazole ring, etc.

As the anion shown by $Y^{\ominus}$, there are halogen ions (e.g., chlorine ion, bromine ion, etc.), p-toluene-sulfonic acid ions, alkylsulfate ions (e.g., methylsulfate ions, ethylsulfate ions, etc.), perchloric acid ions, persulfate ions, etc.

The quaternary nitrogen-containing unsaturated heterocyclic ring shown by Q includes pyridinium, α-picolinum, imidazolinium, quinolinium, etc.

In the compounds shown by the general formula (I) or (II) shown above, the compounds shown by the general formula (I) are preferably used in this invention and more preferred compounds are the compounds of the general formula (I) wherein X represents a hydrogen atom,

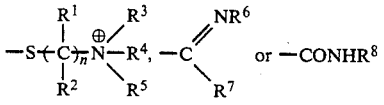

(wherein, $R^1$ to $R^8$ have the same meaning as defined in the general formula (I)).

Specific examples of the compounds represented by the general formula (I) or (II) are set forth below, but the present invention should not be construed as being limited thereto.

$(CH_3)_3\overset{\oplus}{N}CH_2CH_2SH.ClO_4^{\ominus}$ (1)

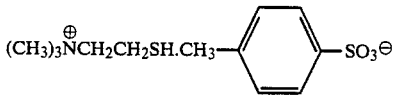
(2)

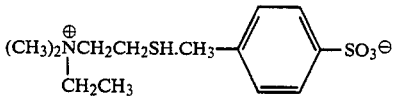
(3)

$(CH_3)_2\overset{\oplus}{N}(CH_2CH_2OH)CH_2CH_2SH.Cl^{\ominus}$ (4)

$(C_2H_5)_3\overset{\oplus}{N}(CH_2)_3SH.CH_3SO_4^{\ominus}$ (5)

-continued

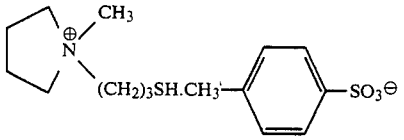
(6)

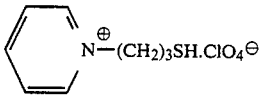
(7)

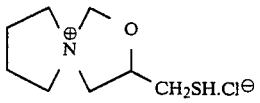
(8)

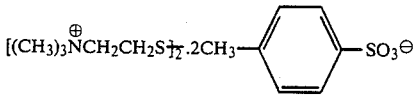
(9)

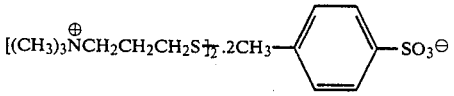
(10)

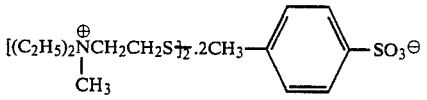
(11)

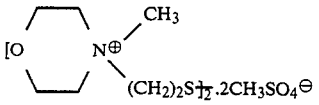
(12)

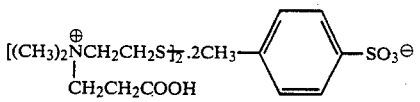
(13)

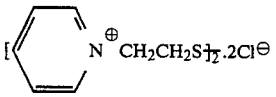
(14)

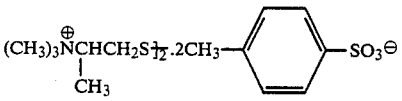
(15)

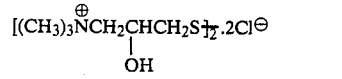
(16)

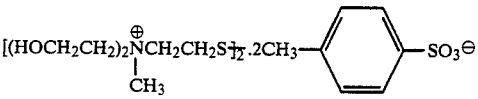
(17)

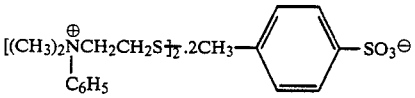
(18)

$[(CH_3)_3\overset{\oplus}{N}CH_2SCOCH_3].Cl^{\ominus}$ (19)

-continued

(20) $[(CH_3)_3\overset{\oplus}{N}CH_2CH_2CH_2SCOCH_3].Cl^{\ominus}$

(21) $[(CH_3)_3\overset{\oplus}{N}CH_2CH_2CH_2SCONHCH_3].Cl^{\ominus}$

(22) 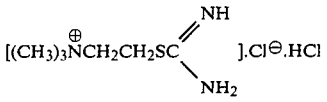

(23) 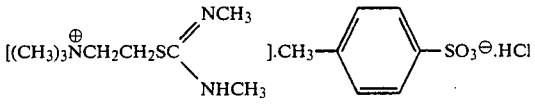

(24) 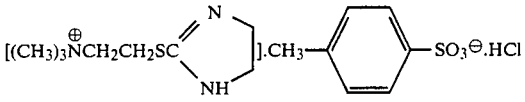

(25) 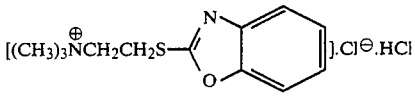

The compounds represented by the general formula (I) or (II) may further form their salts, if the compounds have groups capable of forming salts such as a carboxy group, an amino group, etc.

The compounds shown by the above-described general formula (I) or (II) can be prepared by the methods described in, for example, French Pat. No. 1,175,698; *Yakugaku Kenkyu,* Vol. 22, No. 11, 464–466(1950); *Research Disclosure,* No. 20821 (August, 1981), etc., or the manners similar to the aforesaid methods.

At least one of the compounds represented by the general formula (I) or (II) used in the present invention as a bleach accelerating agent can be incorporated only into either a bleaching bath, a bleach-fixing bath or a prebath thereof. Alternatively, at least one of the compounds can be incorporated into both a bleaching bath or a bleach-fixing bath and a prebath thereof.

The amount of at least one of the compounds according to the present invention added to these solutions varies depending upon the kind of processing solution, kind of color photosensitive material to be processed, processing temperature, time necessary for conducting intended processing, etc. However, an amount of $1\times10^{-5}$ to 1 mol per liter of a processing solution is suitable, with $1\times10^{-4}$ to $1\times10^{-1}$ mol being preferable. In general, however, when the amount added is small, there results a small bleach accelerating effect, whereas when the amount is more than is necessary, a precipitate may be formed which stains processed materials. Therefore, the best range is properly determined with consideration for individual cases.

At least one of the compounds according to the present invention is generally added to a processing solution by previously dissolving it in water, an alkali, an organic acid, or the like. If necessary, an organic solvent such as methanol, ethanol, ethylene glycol, diethylene glycol, etc. may be used for dissolving at least one of the compounds without adversely affecting its bleach accelerating effect.

When incorporating at least one of the compounds according to the present invention into a prebath of a bleaching solution or a bleach-fixing solution, the prebath may have various compositions. A prebath having the simplest composition is an aqueous solution prepared by merely dissolving at least one of the compounds according to the present invention in water. Aqueous solution properly containing acids such as acetic acid, boric acid, etc., alkalis such as sodium hydroxide, etc., or salts such as sodium sulfite, sodium acetate, sodium thiosulfate, sodium borate, sodium carbonate, sodium bicarbonate, etc., are also usable as prebaths with advantage. Prebaths having any pH may be used with satisfactory effects in the present invention. However, too high of a pH may generate stain, and hence prebaths having a pH of 9 or less are generally preferable. The prebath may further contain, if necessary, precipitation preventing agents comprising various chelate compounds; hardeners comprising various compounds including alums or aldehydes; pH buffers; fixing agents for halides; antioxidants such as sulfites, hydroxylamine, hydrazine, etc.; swelling preventing agents such as sodium sulfate, magnesium sulfate, etc.; surfactants; and the like.

Between the prebath and the bleaching bath or the bleach-fixing bath may be provided, for example, a water washing step, stopping step, fixing step, or the like. In such case, the addition of at least one of the compounds according to the present invention to the prebath will also bring about the same bleach accelerating effect. However, where at least one of the compounds according to the present invention is incorporated only in the prebath, the prebath is preferably provided immediately before a bleaching bath or a bleach-fixing bath.

In the bleaching solution or bleach-fixing solution of the present invention, a bleaching agent having a weak bleaching ability is used. A ferric ion complex, one of the bleaching agents, is a complex of ferric ion and a chelating agent such as an aminopolycarboxylic acid, an aminopolyphosphonic acid or the salt thereof. Aminopolycarboxylic acid salts or aminopolyphosphonic acid salts are alkali metal salts, ammonium salts or water-soluble amine salts of aminopolycarboxylic acids or aminopolyphosphonic acids. The alkali metals include sodium, potassium, lithium, etc., and water-soluble amines include alkylamines (e.g., methylamine, diethylamine, triethylamine, butylamine, etc.), alicyclic amines (e.g., cyclohexylamine), arylamines (e.g., aniline, m-toluidine, etc.), and heterocyclic amines (e.g., pyridine, morpholine, piperidine, etc.).

Typical examples of these chelating agents, i.e., aminopolycarboxylic acids, aminopolyphosphonic acids, and the salts thereof are:

Ethylenediaminetetraacetic acid;
Disodium ethylenediaminetetraacetate;
Diammonium ethylenediaminetetraacetate;
Tetra(trimethylammonium)ethylenediaminetetraacetate;
Tetrapotassium ethylenediaminetetraacetate;
Tetrasodium ethylenediaminetetraacetate;
Trisodium ethylenediaminetetraacetate;
Diethylenetriaminepentaacetic acid;
Pentasodium diethylenetriaminepentaacetate;
Ethylenediamine-N-(β-oxyethyl)-N,N′,N′-triacetic acid;
Trisodium ethylenediamine-N-(β-oxyethyl)-N,N′,N′-triacetate;
Triammonium ethylenediamine-N-(β-oxyethyl)-N,N′,N′-triacetate;
Propylenediaminetetraacetic acid;

Disodium propylenediaminetetraacetate;
Nitrilotriacetic acid;
Trisodium nitrilotriacetate;
Cyclohexanediaminetetraacetic acid;
Disodium cyclohexanediaminetetraacetate;
Iminodiacetic acid;
Dihydroxyethylglycine;
Ethyl ether diaminetetraacetic acid;
Glycol ether diaminetetraacetic acid;
Ethylenediaminetetrapropionic acid;
Phenylenediaminetetraacetic acid;
1,3-Diaminopropanol-N,N,N',N'-tetramethylenephosphonic acid;
Ethylenediamine-N,N,N',N'-tetramethylenephosphonic acid;
1,3-Propylenediamine-N,N,N',N'-tetramethylenephosphonic acid; etc.

The present invention is not limited to the above illustrated chelating agents.

The ferric ion complex salts may be used in the form of a complex salt per se or may be formed in situ in solution by using a ferric salt (e.g., ferric sulfate, ferric chloride, ferric nitrate, ferric ammonium sulfate or ferric phosphate, etc.) and a chelating agent (e.g., aminopolycarboxylic acid, aminopolyphosphonic acid or phosphonocarboxylic acid, etc.). When they are used in the form of a complex salt, they may be used alone or as a combination of two or more. On the other hand, where a complex is formed in situ in solution by using a ferric salt and a chelating agent, one, two or more ferric salts may be used. Further, one, two or more chelating agents may also be used. In every case, a chelating agent may be used in an excess amount of being necessary for forming a ferric ion complex salt.

A bleaching solution or a bleach-fixing solution containing the above-described ferric ion complex may further contain complexes of metals other than iron such as cobalt or copper or hydrogen peroxide.

The bleaching solution used in the present invention can contain re-halogenating agents such as bromides (e.g., potassium bromide, sodium bromide, ammonium bromide, etc.), chlorides (e.g., potassium chloride, sodium chloride, ammonium chloride, etc.), and the like in addition to the bleaching agents such as ferric ion complex salts, etc., and the above described compounds. Further, additives which have a pH buffering ability such as inorganic acids, organic acids, or the salts thereof which are known to be used in ordinary bleaching solutions (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.) may be added.

The amount of bleaching agent is from 0.1 to 2 mols per liter of the bleaching solution, and the pH of the bleaching solution is desirably from 3.0 to 8.0 particularly from 4.0 to 7.0, when a ferric ion complex salt is used.

On the other hand, in a bleach-fixing solution employed according to the present invention, ordinary fixing agents, i.e., water-soluble silver halide solvents such as thiosulfates (e.g., sodium thiosulfate, ammonium thiosulfate, ammonium sodium thiosulfate, potassium thiosulfate, etc.); thiocyanates (e.g., sodium thiocyanate, ammonium thiocyanate, potassium thiocyanate, etc.); thioether compounds (e.g., ethylenebisthioglycolic acid, 3,6-dithia-1,8-octanediol, etc.); and thioureas may be used alone or as a combination of two or more. In addition, special bleach-fixing solution comprising a combination of fixing agent and a large amount of a halide compound such as potassium iodide as described in Japanese Patent Application (OPI) No. 155354/80 can be used as well.

In the bleach-fixing solution, it is desirable that the ferric ion complex salt is present in an amount of 0.1 to 2 mols and the amount of fixing agent is from 0.2 to 4 mols, per liter of the bleach-fixing solution.

A bleach-fixing solution can contain the aforesaid additives to be added to the bleaching solution and preservatives such as sulfites (e.g., sodium sulfite, potassium sulfite, ammonium sulfite, etc.), hydroxylamine, hydrazine, aldehyde-bisulfite adducts (e.g., acetaldehyde-sodium bisulfite adduct), etc. Further, various brightening agents, defoaming agents, surfactants, organic solvents (e.g., methanol), and known bleach-fixing accelerating agents (e.g., polyamine compounds as described in Japanese Patent Publication No. 8836/70 (corresponding to U.S. Pat. No. 3,578,454), thiourea derivatives as described in Japanese Patent Publication No. 8506/70 (corresponding to British Pat. No. 1,150,466), iodides as described in West German Pat. No. 1,127,715, polyethylene oxides as described in West German Pat. No. 966,410, nitrogen-containing heterocyclic compounds as described in West German Pat. No. 1,290,812, and other thioureas) may be used. The pH of the bleach-fixing solution upon use is usually from 4.0 to 9.0, particularly preferably from 5.0 to 8.0.

The above described bleaching solution or bleach-fixing solution can be a bleaching solution or a bleach-fixing solution for use as is or for use as a replenisher and a solution used for manufacturing a bleaching solution or a bleach-fixing solution for use as is or use as a replenisher. When two or more liquid preparations are used, the pH of the liquid preparation containing a ferric ion complex salt can be further increased irrespective of the pH range as described above.

Primary aromatic amine color developing agents to be used in the present invention in a color developing solution include a wide range of known developing agents for use in various color photographic processes. The developing agents include aminophenol derivatives and p-phenylenediamine derivatives. These compounds are generally used in the form of salts such as hydrochlorides or sulfates rather than in free form in view of stability advantages. They are generally used in an amount of from about 0.1 g to about 30 g, more preferably from about 1 g to about 15 g, per liter of color developing solution.

The aminophenol type developing agents include, for example, o-aminophenol, p-aminophenol, 5-amino-2-hydroxytoluene, 2-amino-3-hydroxytoluene, 2-hydroxy-3-amino-1,4-dimethylbenzene, etc.

Particularly useful aromatic primary amine type color developing agents are N,N-dialkyl-p-phenylenediamine compounds where the alkyl group and the phenyl group may or may not be substituted. Of these, particularly useful compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, 4-amino-N-(2-methoxyethyl)-N-ethyl-3-methylaniline-p-toluenesulfonate, etc.

The alkaline color developing solution used in the present invention can optionally contain, in addition to the above described aromatic primary amine color developing agent, various ingredients usually added to a color developing solution, such as alkali agents (e.g., sodium hydroxide, sodium carbonate, potassium carbonate, etc.), alkali metal sulfites, alkali metal bisulfites, alkali metal thiocyanates, alkali metal halides, benzyl alcohol, water softening agents, thickening agents, etc. The pH of the color developing solution is usually 7 or above, most generally from about 9 to about 13.

The method of the present invention is applicable to color reversal processing. In the present invention, as a black-and-white first developing solution to be used in such processing, a black-and-white developing solution used for reversal processing of color photosensitive materials or used for processing black-and-white photosensitive materials can be used. In addition, various well known additives generally added to a black-and-white first developing solution can be incorporated in the solution.

Typical additives include developing agents such as 1-phenyl-3-pyrazolidone, metol, and hydroquinone; preservatives such as sulfites; alkalis such as sodium hydroxide, sodium carbonate, or potassium carbonate; inorganic or organic inhibitors such as potassium bromide, 2-methylbenzimidazole, methylbenzothiazole, etc.; water softening agents such as polyphosphoric acid salts; and slight amounts of development restrainers comprising an iodide or a mercapto compounds.

The processing method according to the present invention comprises a processing step such as fixing, etc. in addition to the above described color development and bleaching. After the fixing step or the bleach-fixing step, it is general to carry out processing steps such as water washing and stabilizing, etc. It is also possible to employ a simple processing method, for example, a method wherein only a water washing step or, conversely, only a stabilizing step without conducting a substantial water washing step is carried out. To water for use in the water washing step, may be incorporated known additives, if desired. Examples of such additives include a chelating agent such as an inorganic phosphoric acid, an aminopolycarboxylic acid, an organic phosphoric acid, etc., a germicidal agent or an antifungal agent for preventing the propagation of various bacteria and algae, a hardening agent such as a magnesium salt, an aluminium salt, etc., or a surface active agent for reducing drying load or preventing drying mark, or the like. Further, the compounds as described in L. E. West, "Water Quality Criteria" in Photo. Sci. and Eng., Vol. 9, No. 6, pages 344 to 359 (1965) may be added thereto.

Further, a water washing step may be carried out using two or more tanks, if desired. Moreover, it is possible to employ a multi-stage countercurrent, water washing process (for example, using two to nine tanks) in order to cut down an amount of water for washing.

As a stabilizing solution used in a stabilizing step, a processing solution for stabilizing dye images is employed. For example, a solution having a buffering function to maintain a pH of 3 to 6, a solution containing an aldehyde (for example, formalin, etc.), etc. can be employed. In the stabilizing solution, a brightening agent, a chelating agent, a germicidal agent, an antifungal agent, a hardening agent, a surface active agent, etc. may be used, if desired.

Further, a stabilizing step may be carried out using two or more tanks, if desired. Moreover, it is possible to employ a multi-stage countercurrent stabilizing process (for example, using two to nine tanks) in order to cut down an amount of the stabilizing solution and eliminate a water washing step.

Color photosensitive materials processed according to the present invention in the presence of the compounds according to the present invention are known color photosensitive materials. The present invention is particularly advantageous for processing coupler-containing multilayer negative color photosensitive materials or color print photosensitive materials or for processing color photosensitive materials designed to be subjected to reversal color processing. In addition, color X-ray photosensitive materials, monolayer special color photosensitive materials, color photosensitive materials containing a black-and-white developing agent such as a 3-pyrazolidone as described in U.S. Pat. Nos. 2,751,297 and 3,902,905 and Japanese Patent Application (OPI) Nos. 64339/81, 85748/81 and 95749/81, and color photosensitive materials containing a color developing agent precursor as described in U.S. Pat. Nos. 2,478,400, 3,342,597, 3,342,599, 3,719,492 and 4,214,047 and Japanese Patent Application (OPI) No. 135628/78 can be processed according to the present invention. Further, the processing may be conducted with a coupler in the developing solution.

In a photographic emulsion layer of a color photosensitive material used in the present invention, any of silver bromide, silver iodobromide, silver iodochlorobromide, silver chlorobromide, and silver chloride may be used as a silver halide.

During formation or physical ripening of the silver halide grains, cadmium salts, zinc salts, lead salts, thallium salts, iridium salts or complex salts thereof, rhodium salts or complex salts thereof, iron salts or complex salts thereof, etc., may be present.

In the present invention, both negative emulsions forming surface latent images and direct reversal emulsions can be used. Examples of the latter emulsions include emulsions forming internal latent images and previously fogged direct reversal emulsions.

The silver halide emulsions used are preferably chemically sensitized. That is, sulfur sensitization using sulfur-containing compounds capable of reacting with silver ions or active gelatin, reduction sensitization using a reductive substance, and noble metal sensitization using compounds of noble metals such as gold can be employed alone or in combination. Examples of useful sulfur sensitizers include thiosulfates, thioureas, thiazoles, rhodanines, and other compounds. Examples of useful reduction sensitizers include stannous salts, amines, hydrazine derivatives, formamidinesulfinic acids and silane compounds. For noble metal sensitization, complexes of group VIII metals in the Periodic Table such as platinum, iridium, palladium, etc., can be used as well as gold complexes.

The photographic emulsions may be spectrally sensitized with methine dyes or the like. Dyes used include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes, merocyanine dyes and complex merocyanine dyes.

The color photosensitive material according to the present invention may contain a polyalkylene oxide or its ether, ester or amine derivatives thereof, a thioether compound, a thiomorpholine, a quaternary ammonium salt compound, a urethane derivative, a urea derivative, an imidazole derivative, a 3-pyrazolidone, etc., for the purpose of increasing sensitivity or contrast or for accelerating development.

As binders for photographic emulsion layers or other layers, gelatin is advantageously employed, but other hydrophilic colloids may also be used.

Various compounds may be incorporated in the color photosensitive material according to the present invention as antifoggants or stabilizers. That is, many compounds known as antifoggants or stabilizers such as azoles (e.g., benzothiazolium salts, nitroindazoles, triazoles, benzotriazoles, benzimidazoles (Particularly, nitro- or halogen-substituted derivatives), etc.); heterocyclic mercapto compounds (e.g., mercaptothiazoles, mercaptobenzothiazoles, mercaptobenzimidazoles, mercaptothiadiazoles, mercaptotetrazoles (e.g., 1-phenyl-5-mercaptotetrazole), and mercaptopyrimidines); the above described heterocyclic mercapto compounds having a water-soluble group such as a carboxyl group or a sulfo group; thioketo compounds (e.g., oxazolinethione); azaindenes (e.g., tetraazaindenes (particularly 4-hydroxy-substituted (1,3,3a,7)tetraazaindenes)); benzenethiosulfonic acids; benzenesulfinic acids; etc., can be added.

The color photosensitive material according to the present invention may contain an organic or inorganic hardener in its photographic emulsion layers or other layers. For example, chromium salts, aldehydes, active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids, etc., can be used alone or in combination.

The color photosensitive material according to the present invention may contain in its photographic emulsion layers or other layers various surface active agents for various purposes such as improvement of coating properties, antistatic properties, slipping properties, emulsion dispersibility, anti-adhesion properties, and photographic properties (for example, development acceleration, increase in contrast, sensitization, etc.).

The color photosensitive material according to the present invention contains in its photographic emulsion layers color forming couplers, that is, compounds capable of forming color by oxidative coupling with an aromatic primary amine developing agent (for example, a phenylenediamine derivative or an aminophenol derivative) in color development processing. For example, magenta couplers include 5-pyrazolone couplers, pyrazolobenzimidazole couplers, cyanoacetylcoumarone couplers, open chain acylacetonitrile couplers, etc., yellow couplers include acylacetamide couplers (e.g., benzoylacetanilides, pivaloylacetanilides, etc.), and cyan couplers include naphthol couplers, phenol couplers, etc. Further, couplers, for example, those as described in U.S. Pat. Nos. 4,124,396, 4,327,173, 4,333,999 and 4,334,011, Japanese Patent Application (OPI) Nos. 155538/82, 204545/82, 105229/83, 31953/84, 31954/84 and 34536/84, etc. can be used. Of these couplers, nondiffusible couplers having a hydrophobic group called a ballast group in their molecules are desirable. The coupler may be of either 4-equivalent type or 2-equivalent type to silver ions. Colored couplers having a color correcting effect or couplers capable of releasing a development inhibitor upon development (so-called DIR couplers) may also be used. In addition to DIR couplers, non-color forming DIR coupling compounds capable of forming a colorless coupling reaction product and releasing a development inhibitor and DIR redox compounds may also be incorporated.

The color photosensitive materials according to the present invention can contain a developing agent, including those described in *Research Disclosure,* Vol. 176, page 29 under the item of "Developing agents".

The color photosensitive material prepared according to the present invention may contain a dye in its photographic emulsion layers or other constituting layers as a filter dye or for various purposes such as prevention of irradiation. Examples of such dyes include those described in *Research Disclosure,* Vol. 176, pages 25 and 26 under the item of "Absorbing and filter dyes".

The color photosensitive material according to the present invention can further contain antistatic agents, plasticizers, matting agents, lubricants, ultraviolet ray absorbing agents, brightening agents, air fog preventing agents, etc.

Silver halide emulsion layers and/or other constituting layers are coated on a support by a procedure such as described in *Research Disclosure,* Vol. 176, pages 27 and 28, under the item of "Coating procedures".

Since the compounds according to the present invention have the extremely high bleach accelerating effect, it is possible to attain sufficient desilveration in a short processing time even when a bleaching agent with weak bleaching ability is used. Also, the compounds according to the present invention do not adversely affect photographic properties such as color formation, sensitivity and stain properties. Further, the compounds according to the present invention can stably exist in a processing bath for such a long time that problems with control of the bath can be decreased.

That is, it has been discovered that by incorporating the compounds shown by the above-described general formula (I) or (II) or the salts thereof for use in this invention in a bleach bath or a blix bath containing a ferric complex salt as a bleaching agent or a prebath for the bleach or blix bath, the bleach speed can be accelerated as well as when color photosensitive materials are continuously processed by the bleach bath or the blix bath, no precipitations form in the bleach bath or blix bath.

The following examples are intended to illustrate the present invention but not to limit it any way.

EXAMPLE 1

After image exposing color negative films, Fuji Color HR100 (24 exposures, trademark, made by Fuji Photo Film Co., Ltd.), the exposed films were continuous processed according to the following processing steps. In this case, the bleaching solution used for the processing step contained the compounds of general formula (I) or (II) for use in this invention as shown in Table 2 below.

| Processing Step | Temperature | Time |
|---|---|---|
| Color Development | 38° C. | 3 min. |
| Bleach | 38° C. | 1 min. 30 sec. |
| Fix | 38° C. | 3 min. |
| Wash | 38° C. | 3 min. |
| Stabilization | 38° C. | 1 min. |

In addition, the above-described processing was started using 500 ml of each mother liquid of the processing solutions having the compositions described hereinafter and then, while supplying each replenisher for the processing solutions having the compositions described hereafter at ratios shown in Table 1 below after processing every one roll film of color negative film, HR100 (24 exposures, trademark, made by Fuji Photo Film Co., Ltd.), 80 roll films were continuously processed and the number of roll films processed until precipitations were observed by the naked eye in the bleach solution was detected.

Also, after applying uniform light exposure of 25 CMS to a color negative film, HR400 (24 exposures, trademark, made by Fuji Photo Film Co., Ltd.) using a tungsten light source controlled to a color temperature of 4800° K. with a filter, the color negative film was processed according to the above-described processing steps using, in this case, each mother liquid of the bleaching solutions shown in Table 2 in the states before performing the continuous processing of color negative films and then the silver amount remaining on each film sample was measured by X-ray fluorescent analysis.

The results thus obtained are also shown in Table 2 below.

TABLE 1

| Processing Step | Replenisher Amount per One Roll Film, HR100 (24 Exposures) |
|---|---|
| Color Development | 50 ml |
| Bleach | 20 ml |
| Fix | 40 ml |
| Wash | Running Water |
| Stabilization | 40 ml |

The compositions of the processing solutions used in the above processing steps were as follows.

| Color Developer: | Mother Liquid | Replenisher |
|---|---|---|
| Sodium Nitrilotriacetate | 1.0 g | 1.1 g |
| Sodium Sulfite | 4.0 g | 4.4 g |

-continued

| Color Developer: | Mother Liquid | Replenisher |
|---|---|---|
| Sodium Carbonate | 30.0 g | 32.0 g |
| Potassium Bromide | 1.4 g | 0.7 g |
| Hydroxylamine Sulfate | 2.4 g | 2.6 g |
| 4-(N—Ethyl-N—β-hydroxyethylamino)-2-methylaniline Sulfate | 4.5 g | 5.0 g |
| Water to make | 1 liter | 1 liter |

| Bleach Solution: | Mother Liquid | Replenisher |
|---|---|---|
| Ammonium Bromide | 160.0 g | 175 g |
| Aqueous Ammonia (28%) | 25.0 ml | 15 ml |
| Sodium Ethylenediamine-tetraacetato ferrate | 130.0 g | 143 g |
| Glacial Acetic Acid | 14.0 ml | 14.0 ml |
| Compound (shown in Table 2) of the General Formula (I) or (II) | Table 2 | Table 2 |
| Water to make | 1 liter | 1 liter |

| Fix Solution: | Mother Liquid | Replenisher |
|---|---|---|
| Sodium Tetrapolyphosphate | 2.0 g | 2.2 g |
| Sodium Sulfite | 4.0 g | 4.4 g |
| Ammonium Thiosulfate (70%) | 175.0 ml | 193.0 ml |
| Sodium Hydrogensulfite | 4.6 g | 5.1 g |
| Water to make | 1 liter | 1 liter |

| Stabilization Solution: | Mother Liquid | Replenisher |
|---|---|---|
| Formalin | 8.0 ml | 9.0 ml |
| Water to make | 1 liter | 1 liter |

TABLE 2

| Sample No. | Bleach Accelerator: Compound | Bleach Accelerator: Concentration in Mother Liquid (mole/liter) | Bleach Accelerator: Concentration in Replenisher (mole/liter) | No. of Roll Films (24 Exposures) Processed Before the Formation Precipitations* | Remaining Silver Amount ($\mu g/cm^2$) |
|---|---|---|---|---|---|
| 1** | none | $5 \times 10^{-3}$ | $6 \times 10^{-3}$ | No precipitation formed after processing 80 rolls | 18.0 |
| 2 | Compound (2) | $5 \times 10^{-3}$ | $6 \times 10^{-3}$ | No precipitation formed after processing 80 rolls | 4.6 |
| 3 | Compound (7) | $5 \times 10^{-3}$ | $6 \times 10^{-3}$ | No precipitation formed after processing 80 rolls | 6.2 |
| 4 | Compound (9) | $5 \times 10^{-3}$ | $6 \times 10^{-3}$ | No precipitation formed after processing 80 rolls | 3.5 |
| 5 | Compound (13) | $5 \times 10^{-3}$ | $6 \times 10^{-3}$ | No precipitation formed after processing 80 rolls | 4.0 |
| 6 | Compound (14) | $5 \times 10^{-3}$ | $6 \times 10^{-3}$ | No precipitation formed after processing 80 rolls | 6.5 |
| 7 | Compound (16) | $5 \times 10^{-3}$ | $6 \times 10^{-3}$ | No precipitation formed after processing 80 rolls | 5.1 |
| 8 | Compound (20) | $5 \times 10^{-3}$ | $6 \times 10^{-3}$ | No precipitation | 6.7 |

TABLE 2-continued

| Sample No. | Bleach Accelerator Compound | Concentration in Mother Liquid (mole/liter) | Concentration in Replenisher (mole/liter) | No. of Roll Films (24 Exposures) Processed Before the Formation Precipitations* | Remaining Silver Amount ($\mu g/cm^2$) |
|---|---|---|---|---|---|
| | | | | formed after processing 80 rolls | |
| 9 | Compound (21) | $5 \times 10^{-3}$ | $6 \times 10^{-3}$ | No precipitation formed after processing 80 rolls | 4.4 |
| 10 | Compound (22) | $5 \times 10^{-3}$ | $6 \times 10^{-3}$ | No precipitation formed after processing 80 rolls | 4.2 |
| 11 | Compound (23) | $5 \times 10^{-3}$ | $6 \times 10^{-3}$ | No precipitation formed after processing 80 rolls | 4.3 |
| 12** | Compound A | $5 \times 10^{-3}$ | $6 \times 10^{-3}$ | Precipitation formed after processing 8 rolls | 11.0 |
| 13** | Compound B | $5 \times 10^{-3}$ | $6 \times 10^{-3}$ | Precipitation formed after processing 7 rolls | 12.0 |

*Larger number of roll films shows larger prevention effect for the formation of precipitations.
**Comparison samples.

Compound A: 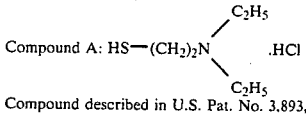

Compound described in U.S. Pat. No. 3,893,858.

Compound B: 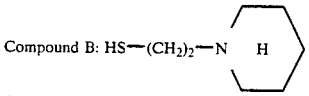

Compound described in Japanese Patent Application (OPI) No. 32736/78.

As is clear from the results shown in Table 2 above, it can be seen that the bleach accelerator for use in this invention shows a large desilveration accelerating ability as compared to the comparison compounds and when the bleaching solution containing the bleach accelerator for use in this invention is used for continuously processing 80 roll films (color negative photographic films), no precipitation forms in the bleaching solution, whereas when the bleaching solution containing the comparison compound is used for the continuous processing, precipitations form in the bleaching solution before processing the tenth roll film, and the comparison compound shows a poor desilveration accelerating ability. In other words, the compounds for use in this invention as bleach accelerator have a high desilveration accelerating ability and has an excellent performance of not forming precipitates in the bleach solution containing the compound even if a large amount of color photosensitive materials are continuously processed by the bleaching solution.

As described above, it can be seen that the compounds for use in this invention are very excellent bleach accelerators which are very stable in bleach bath and show very excellent bleach accelerating ability. The compound for use in this invention enables quick bleach processing with low environmental pollution and without giving any bad influences on the photographic properties.

EXAMPLE 2

The same procedure as Example 1 except that the blix solution having the composition shown below and containing each of the compounds for use in this invention shown in Table 3 below was used in place of the mother liquids of the bleach solution and fix solution was performed (the time for the blix processing was 6 minutes). The amount of silver remaining in the film sample was measured by the same manner as in Example 1. The results thus obtained are shown in following Table 3.

In addition, the composition of the blix solution was as follows.

| Blix Solution: | |
|---|---|
| Ammonium Ethylenediaminetetraacetato Ferrate Dihydrate | 120.0 g |
| Sodium Ethylenediaminetetraacetate | 5.0 g |
| Aqueous Solution of Ammonium Thiosulfate (70%) | 170.0 ml |
| Sodium Sulfate | 10.0 g |
| Water to make | 1.0 liter |
| pH | 6.5 |

Also, 16 g/liter of silver bromide was dissolved in each blix solution containing each of the blix accelerators shown in Table 3 and the formation of precipitates was observed by the naked eye.

The results thus obtained are shown in Table 3.

TABLE 3

| Sample | Bleach Accelerator | Addition Amount to Blix Bath (mole/liter) | Remaining Silver Amount ($\mu g/cm^2$) | Precipitation |
|---|---|---|---|---|
| 14 | none | — | 110 | none |
| 15 | Compound (1) | $1 \times 10^{-2}$ | 6.6 | " |
| 16 | Compound (9) | " | 5.3 | " |
| 17 | Compound (14) | " | 7.2 | " |
| 18 | Compound (21) | " | 6.1 | " |
| 19 | Compound (23) | " | 5.0 | " |
| 20 | Compound (25) | " | 5.7 | " |
| 21 | Compound A | " | 21.4 | Observed |
| 22 | Compound B | " | 46.2 | Observed |

Samples 14, 21 and 22 are comparison samples.
Compounds A and B are same as in Example 1.

As is clear from the results shown in Table 3, it can be seen that when the compound for use in this invention is incorporated in a blix solution, the desilveration rate is greatly accelerated and even when silver ions exist in the blix solution, no precipitation is formed. It can also be seen that in the case of using the known comparison compound for the blix solution, the desilveration accelerating effect is weak and precipitations form when silver ions exist in the blix solution containing the compound.

As described above, it can be seen that the compounds for use in this invention have excellent performance that the addition of the compound to a blix solution gives a high desilveration accelerating ability and does not form precipitations when silver ions exist in the blix solution.

EXAMPLE 3

The same procedure as Example 2 except that a prebath (control bath) having the composition shown below and containing the compound for use in this invention shown in Table 4 below was used in place of the wash bath used before the blix bath in the processing steps of Example 2 was performed. The amount of silver remaining in the film sample was measured by the same manner as in Example 2.

| Control Bath: | |
|---|---|
| Water | 700 ml |
| Sodium Ethylenediaminetetraacetate Dihydrate | 8 g |
| Sodium Sulfite | 12 g |
| Glacial Acetic Acid | 3 ml |
| Water to make | 1000 ml |

TABLE 4

| Sample | Blix Accelerator | Amount to Control Bath (mole/liter) | Remaining Silver Amount ($\mu g/cm^2$) |
|---|---|---|---|
| 23 | none | $1 \times 10^{-2}$ | 120 |
| 24 | Compound (4) | " | 6.5 |
| 25 | Compound (7) | " | 8.1 |
| 26 | Compound (10) | " | 4.3 |
| 27 | Compound (19) | " | 7.0 |
| 28 | Compound (22) | " | 5.2 |
| 29 | Compound B | " | 40.1 |

Compound B is same as Compound B in Example 1.
Samples 23 and 29 are comparison examples.

As is clear from the results shown in Table 4 above, the desilveration was remarkably accelerated by the addition of the compound according to the present invention to the prebath of the bleach-fixing bath. On the contrary, the known Compound B exhibited a poor desilveration accelerating effect.

EXAMPLE 4

On a triacetyl cellulose support provided with a subbing layer were coated in order the emulsion layers and subsidiary layers as described below to prepare a color reversal film.

FIRST LAYER

Low Speed Red-Sensitive Emulsion Layer 100 g of a cyan coupler, i.e., 2-(heptafluorobutyramido)-5-[2'-(2'',4''-di-tert-amylphenoxy)-butyramido]phenol was dissolved in 100 ml of tricresyl phosphate and 100 ml of ethyl acetate and stirred at a high speed together with 1 kg of a 10% aqueous gelatin solution to prepare an emulsion. Then, 500 g of the emulsion thus obtained was mixed with 1 kg of a low speed red-sensitive silver iodobromide emulsion (containing 70 g of silver and 60 g of gelatin, and having an iodide content of 3 mol%), and the resulting mixture was then coated at a dry layer thickness of 2$\mu$ (silver amount: 0.5 $g/m^2$).

SECOND LAYER

High Speed Red-Sensitive Emulsion Layer 100 g of cyan coupler, i.e., 2-(heptafluorobutyramido)-5-[2'-(2'',4''-di-tert-amylphenoxy)-butyramido]phenol was dissolved in 100 ml of tricresyl phosphate and 100 ml of ethyl acetate and stirred at a high speed together with 1 kg of 10% aqueous solution to prepare an emulsion. Then, 1,000 g of the emulsion thus obtained was mixed with 1 kg of a high speed red-sensitive silver iodobromide emulsion (containing 70 g of silver and 60 g of gelatin, and having an iodide content of 3 mol%), and the resulting mixture was then coated at a dry layer thickness of 2$\mu$ (silver amount: 0.8 $g/m^2$).

THIRD LAYER

Intermediate Layer 2,5-Di-tert-octylhydroquinone was dissolved in 100 ml of dibutyl phthalate and 100 ml of ethyl acetate and stirred at a high speed together with 1 kg of a 10% aqueous gelatin solution to prepare an emulsion. Then, 1 kg of the emulsion thus obtained was mixed with 1 kg of a 10% aqueous gelatin solution, and the resulting mixture was coated at a dry layer thickness of 1$\mu$.

FOURTH LAYER

Low Speed Green-Sensitive Emulsion Layer

An emulsion was prepared in the same manner as described in the preparation of the emulsion for the first layer except that a magenta coupler, i.e., 1-(2,4,6-trichlorophyenyl)-3-[3-(2,4-di-tert-amylphenoxyacetamido)benzamido]-5-pyrazolone, was used in place of the cyan coupler. Then, 500 g of the emulsion thus obtained was mixed with 1 kg of a low speed green-sensitive silver iodobromide emulsion (containing 70 g of silver and 60 g of gelatin and having an iodine content of 2.5 mol%), and the resulting mixture was coated at a dry layer thickness of 2.0$\mu$ (silver amount: 0.7 $g/m^2$).

FIFTH LAYER

High Speed Green-Sensitive Emulsion Layer

An emulsion was prepared in the same manner as described in the preparation of the emulsion for the first layer except that a magenta coupler, i.e., 1-(2,4,6-trichlorophenol)-3-[3-(2,4-di-tert-amylphenoxyacetamido)benzamido]-5-pyrazolene, was used in place of the cyan coupler. Then, 1,000 g of the emulsion thus obtained was mixed with 1 kg of a high speed green-sensitive silver iodobromide emulsion (containing 70 g of silver and 60 g of gelatin and having an iodide content of 2.5 mol%), and the resulting mixture was coated at a dry layer thickness of 2.0$\mu$ (silver amount: 0.7 $g/m^2$).

SIXTH LAYER

Intermediate Layer 1 kg of the emulsion used in the preparation of the third layer was mixed with 1 kg of a 10% aqueous gelatin solution and coated at a dry layer thickness of 1$\mu$.

SEVENTH LAYER

Yellow Filter Layer

An emulsion containing yellow colloidal silver was coated at a dry layer thickness of 1μ.

EIGHTH LAYER

Low Speed Blue-Sensitive Emulsion Layer

An emulsion was prepared in the same manner as described in the preparation of the emulsion for the first layer except that a yellow coupler, i.e., α-(pivaloyl)-α-(1-benzyl-5-ethoxy-3-hydantoinyl)-2-chloro-5-dodecyloxycarbonylacetanilide, was used in place of the cyan coupler. Then, 1,000 g of the emulsion thus obtained was mixed with 1 kg of a low speed blue-sensitive silver iodobromide emulsion (containing 70 g of silver and 60 g of gelatin and having an iodine content of 2.5 mol%) and the resulting mixture was coated at a dry layer thickness of 2.0μ (silver amount: 0.6 g/m$^2$).

NINTH LAYER

High Speed Blue-Sensitive Emulsion Layer

An emulsion was prepared in the same manner as described in the preparation of the emulsion for the first layer except that a yellow coupler, i.e., α-(pivaloyl)-α-(1-benzyl-5-ethoxy-3-hydantoinyl)-2-chloro-5-dodecyloxycarbonylacetanilide, was used in place of the cyan coupler. Then, 1,000 g of the emulsion thus obtained was mixed with 1 kg of a high speed blue-sensitive silver iodobromide emulsion (containing 70 g of silver and 60 g of gelatin and having an iodine content of 2.5 mol%), and the resulting mixture was coated at a dry layer thickness of 2.0μ (silver amount: 1.0 g/m$^2$).

TENTH LAYER

Second Protective Layer 1 kg of the emulsion used in the preparation of the third layer was mixed with 1 kg of a 10% aqueous gelatin solution and coated at a dry later thickness of 2μ.

ELEVENTH LAYER

First Protective Layer

A 10% aqueous gelatin solution containing a fine grain emulsion which had not been chemically sensitized (grain size: 0.15μ; silver iodobromide emulsion having an iodine content of 1.0 mol%) was coated so that the amount of silver coated was 0.3 g/m$^2$ and the dry layer thickness was 1μ.

The color reversal film thus obtained was subjected to exposure at a proper exposure amount to light having a color temperature of 4,800° K. (adjusted using a filter) from a tungsten light source and then to development processing according to the processing steps described below using various bleaching baths containing the compounds according to the present invention.

| Processing Steps | Time (min) | Temperature |
|---|---|---|
| First Developing Bath | 6 | 38° C. |
| Washing with Water | 2 | " |
| Reversal Bath | 2 | " |
| Color Developing Bath | 6 | " |
| Washing with Water | 2 | " |
| Bleaching Bath | 5 | " |
| Fixing Bath | 4 | " |
| Washing with Water | 4 | " |

-continued

| Processing Steps | Time (min) | Temperature |
|---|---|---|
| Stabilizing Bath | 1 | Room Temperature |

The composition of each processing solution used in the above described processing was as follows.

| First Developing Bath | |
|---|---|
| Water | 700 ml |
| Sodium Tetrapolyphosphate | 2 g |
| Sodium Sulfite | 20 g |
| Hydroquinone.Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml (pH 10.1) |

| Reversal Bath | |
|---|---|
| Water | 700 ml |
| 6 Na Salt of Nitrilo-N,N,N—trimethylenephosphonic Acid | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |

| Color Developing Bath | |
|---|---|
| Water | 700 ml |
| Sodium Tetrapolyphosphate | 2 g |
| Sodium Sulfite | 7 g |
| Sodium Tertiary Phosphate (12 hydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| Ethylenediamine | 3 g |
| Water to make | 1,000 ml |

| Bleaching Bath | |
|---|---|
| Water | 800 ml |
| Sodium Ethylenediaminetetraacetate Dihydrate | 2.0 g |
| Ammonium Ethylenediaminetetraacetato Ferrate Dihydrate | 120.0 g |
| Potassium Bromide | 100.0 g |
| Water to make | 1,000 ml |

| Fixing Bath | |
|---|---|
| Water | 800 ml |
| Ammonium Thiosulfate | 80.0 g |
| Sodium Sulfite | 5.0 g |
| Sodium Bisulfite | 5.0 g |
| Water to make | 1,000 ml |

| Stabilizing Bath | |
|---|---|
| Water | 800 ml |
| Formalin (37%) | 5.0 ml |
| Fuji Driwel (product of Fuji Photo Film Co., Ltd.) | 5.0 ml |
| Water to make | 1,000 ml |

The silver amount remaining in the maximum density portion of each film sample having been subjected to the development processing as described above was measured according to X-ray fluorometric analysis. The results thus obtained are shown in Table 5 below.

TABLE 5

| Sample | Bleach Accelerating Agent | Amount Added to Bleaching Bath | Amount of Remaining Silver ($\mu g/cm^2$) |
|---|---|---|---|
| 30 | Not added | — | 18.0 |
| 31 | Compound (2) | $5 \times 10^{-3}$ mol/l | 4.6 |
| 32 | Compound (7) | " | 6.2 |
| 33 | Compound (9) | " | 3.5 |
| 34 | Compound (13) | " | 4.0 |
| 35 | Compound (14) | " | 6.5 |
| 36 | Compound (16) | " | 5.1 |
| 37 | Compound (20) | " | 6.7 |
| 38 | Compound (21) | " | 4.4 |
| 39 | Compound (22) | " | 4.2 |
| 40 | Compound (24) | " | 4.3 |
| 41 | Compound A | " | 11.0 |
| 42 | Compound B | " | 12.5 |

As is clear from Table 5, it can be seen that when the compound for use in this invention is added to the bleaching solution for reversal processing (Sample Nos. 31 to 40), the compound shows large desilveration accelerating ability as compared with the comparison compounds (Sample Nos. 41 and 42).

Also, when color reversal photosensitive materials are continuously processed as in Example 1, precipitations do not form in the bleach solution containing the compound for use in this invention.

While the invention has been described in detail and with reference to specific emobdiments thereof, it will be apparent to one skilled in the art that various changes and modifications can be made therein without departing from the spirit and scope thereof.

What is claimed is:

1. A method for processing a silver halide color photographic material by subjecting a light-exposed silver halide color photographic material to a color development and then subjecting it to bleach processing and fix processing or to blix processing, which comprises performing said bleach processing or blix processing using a bleach bath or a blix bath containing a ferric ion complex salt as a bleaching agent, said bleach bath or blix bath, or a prebath for said bath containing at least one compound represented by the following general formula (I) or (II);

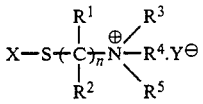

(I)

-continued

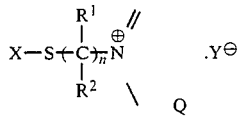

(II)

wherein, X represents a hydrogen atom,

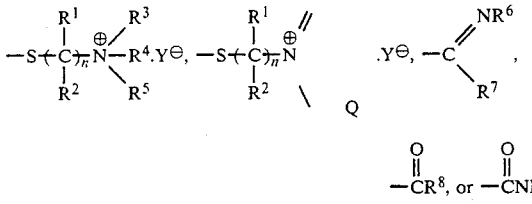

$-CR^8$, or $-CNHR^8$;

$Y^{\ominus}$ represents an anion; Q represents an atomic group necessary for forming a quaternary nitrogen-containing unsaturated heterocyclic ring; n represents an integer of 1 to 5; $R^1$, $R^2$, $R^6$ and $R^8$ each represents a hydrogen atom or a lower alkyl group; $R^3$, $R^4$ and $R^5$ each represents a substituted or unsubstituted alkyl group or a substituted or unsubstituted aryl group; at least two of said $R^3$, $R^4$ and $R^5$ may combine with each other to form a ring; said $R^3$, $R^4$ or $R^5$ and said $R^1$ or $R^2$ may combine with each other to form a ring; and $R^7$ represents $-NR^9R^{10}$, $-OR^{11}$ or $-SR^{11}$ (wherein $R^9$ and $R^{10}$ each represents a hydrogen atom or a lower alkyl group; $R^{11}$ represents an atomic group necessary for forming a ring by combining with $R^6$; and said $R^9$ or $R^{10}$ and $R^6$ may combine with each other to form a ring).

2. A method for processing a silver halide color photographic material as claimed in claim 1, wherein the alkyl group shown by $R^1$ to $R^6$ and $R^8$ to $R^{10}$ is an alkyl group having 1 to 5 carbon atoms.

3. A method for processing a silver halide color photographic material as claimed in claim 1, wherein the substituent of the alkyl group and aryl group shown by $R^3$ to $R^5$ includes a hydroxy group, a carboxy group, a sulfo group, an ammonium group, an alkoxy group, a sulfonyl group, a carbamoyl group, a sulfamoyl group, an amido group, a sulfonamido group, an alkoxycarbonyl group, a carbonyloxy group, a cyano group, and a halogen atom.

4. A method for processing a silver halide color photographic material as claimed in claim 1, wherein the ring formed by the combination of any two of $R^3$, $R^4$ and $R^5$ includes a morpholine ring, a piperidine ring, an imidazole ring and a pyrrolidine ring.

5. A method for processing a silver halide color photographic material as claimed in claim 1, wherein the ring formed by the combination of $R^3$, $R^4$ or $R^5$ and $R^1$ or $R^2$ includes an oxazolidine ring.

6. A method for processing a silver halide color photographic material as claimed in claim 1, wherein the ring formed by the combination of $R^9$ or $R^{10}$ and $R^6$ or the ring formed by the combination of $R^{11}$ and $R^6$ has an imidazoline ring, a benzimidazole ring, a benzothiazole ring, a benzoxazole ring, a pyrimidine ring and a 5-methoxybenzimidazole ring.

7. A method for processing a silver halide color photographic material as claimed in claim 1, wherein the anion shown by $Y^{\ominus}$ includes halogen ions, p-toluenesulfonic acid ions, alkylsulfate ions, perchloric acid ions and persulfate ions.

8. A method for processing a silver halide color photographic material as claimed in claim 1, wherein the quaternary nitrogen-containing unsaturated heterocyclic ring shown by Q includes pyridinium, α-picolinum, imidazolium and quinolium.

9. A method for processing a silver halide color photographic material as claimed in claim 1, wherein said bleach bath or blix bath, or prebath for said bath contains at least one compound represented by the general formula (I).

10. A method for processing a silver halide color photographic material as claimed in claim 9, wherein X in the compounds of the general formula (I) represents a hydrogen atom,

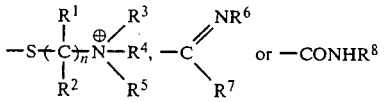

(wherein, $R^1$ to $R^8$ have the same meaning as defined in the general formula (I)).

11. A method for processing a silver halide color photographic material as claimed in claim 1, wherein at least one compound represented by the general formula (I) or (II) is incorporated into the bleaching bath.

12. A method for processing a silver halide color photographic material as claimed in claim 1, wherein at least one compound represented by the general formula (I) or (II) is incorporated into the bleach-fixing bath.

13. A method for processing a silver halide color photographic material as claimed in claim 1, wherein at least one compound represented by the general formula (I) or (II) is incorporated into the prebath of the bleaching bath or bleach-fixing bath.

14. A method for processing a silver halide color photographic material as claimed in claim 1, wherein the amount the at least one compound represented by the general formula (I) or (II) in the bleaching bath, the bleach-fixing bath or the prebath of the bleaching bath or bleach-fixing bath is from $1\times10^{-5}$ to 1 mol per liter of a processing solution.

15. A method for processing a silver halide color photographic material as claimed in claim 13, wherein the prebath is an aqueous solution containing at least one compound represented by the general formula (I) or (II) and has a pH of 9 or less.

16. A method for processing a silver halide color photographic material as claimed in claim 1, wherein the ferric ion complex salt is a complex salt of a ferric ion with a chelating agent consisting of an aminopolycarboxylic acid, an aminopolyphosphonic acid, a phosphonocarboxylic acid.

17. A method for processing a silver halide color photographic material as claimed in claim 1, wherein the amount of the ferric ion complex salt is from 0.1 to 2 mols per liter of the bleaching solution.

18. A method for processing a silver halide color photographic material as claimed in claim 1, wherein the multilayer color photosensitive material is a negative color photosensitive material, a color print photosensitive material or a reversal color photosensitive material.

* * * * *